United States Patent [19]

Clark

[11] Patent Number: 4,693,534

[45] Date of Patent: Sep. 15, 1987

[54] ELECTRIC FED-THRU CONNECTOR ASSEMBLY

[75] Inventor: Bill W. Clark, Houston, Tex.

[73] Assignee: Seaboard Wellhead Control, Inc., Houston, Tex.

[21] Appl. No.: 821,037

[22] Filed: Jan. 22, 1986

Related U.S. Application Data

[63] Continuation of Ser. No. 651,170, Sep. 17, 1984, abandoned.

[51] Int. Cl.[4] ..... H01R 4/00

[52] U.S. Cl. ..... 439/276; 439/275; 439/736

[58] Field of Search ..... 339/94, 136, 141, 60, 339/103 C, 59, 217, 218; 166/315, 88, 65 R

[56] References Cited

U.S. PATENT DOCUMENTS

| | | | |
|---|---|---|---|
| 3,404,363 | 10/1968 | Fischer | 339/94 M |
| 3,477,061 | 11/1969 | Stephenson | 339/94 M |
| 3,945,700 | 3/1976 | Didier | 339/59 M |
| 3,970,352 | 7/1976 | Darrell et al. | 339/94 M |
| 4,041,240 | 8/1977 | Sipovicz | 339/218 M |
| 4,154,302 | 5/1979 | Cugini | 339/94 M |
| 4,426,124 | 1/1984 | Vandevier | 339/94 M |
| 4,583,804 | 4/1986 | Thompson | 339/103 C |

*Primary Examiner*—Gil Weidenfeld

*Assistant Examiner*—David Pirlot

*Attorney, Agent, or Firm*—Matthews & Associates

[57] ABSTRACT

Wellhead electrical connection apparatus for feeding electricity into a well under fluid pressure, includes a mandrel sleeve having an internal sleeve shoulder formed to face high pressure end of sleeve. A performed rigid high mechanical strength dielectric insulator support having an external insulator shoulder is installed within the sleeve with the insulator shoulder in abutment with the internal shoulder of sleeve. Insulator support means is mounted and sealed in physically bonded relation within the interior of the sleeve by means of dielectric potting material disposed as an insulator film or sleeve in surface areas between insulator support and sleeve. Insulator support has a plurality of holes extending in parallel and laterally spaced apart relation through the insulator with each hole having an internal hole shoulder formed to face high pressure end of sleeve. An elongated rigid electrical conductor member having an external conductor shoulder and electrical connectors on each end is installed within each hole with conductor shoulder in abutment with hole shoulder. Each electrical conductor is mounted and sealed in physically bonded relation with interior of hole by a dielectric potting material disposed as a conductor sleeve or film in surface areas between conductor member and side of hole.

40 Claims, 9 Drawing Figures fig.7
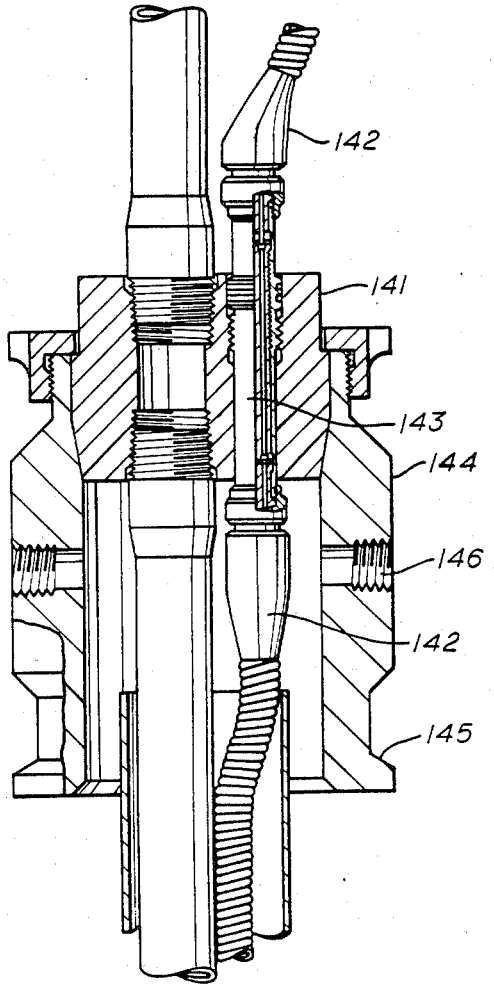
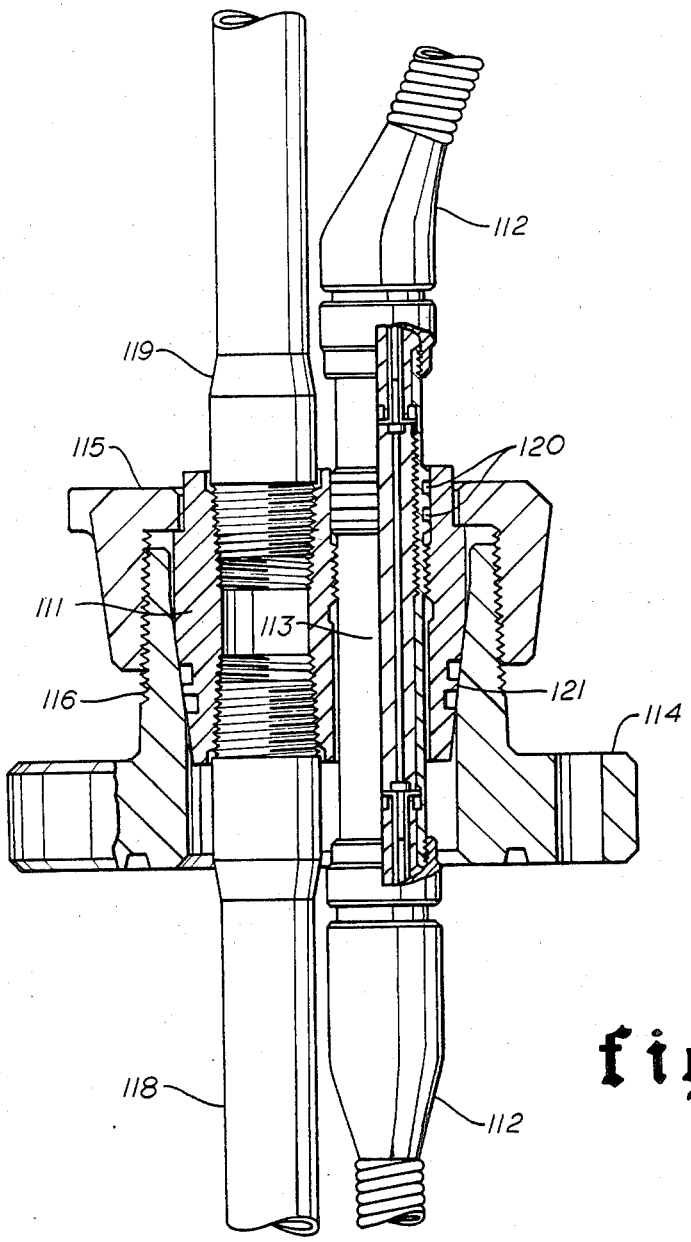
fig.4

ELECTRIC FED-THRU CONNECTOR ASSEMBLY

This application is a continuation of Ser. No. 651,170, filed Sept. 17, 1984 now abandoned.

FIELD OF THE INVENTION

This invention relates to wellhead connectors. More particularly, the present invention pertains to an improved downhole and surface electrical connector assembly.

BACKGROUND OF THE INVENTION

Various approaches are known in the art for passing cable through a wellhead into the interior of the well head casing. Cugini, et al, U.S. Pat. No. 3,437,149 and Sipowicz U.S. Pat. No. 4,041,240, disclose pressure-sensitive cable feed-thru means which extend from the exterior of a wellhead construction through a pressure zone in the wellhead into the interior of a wellhead casing. Therein, coupling means are provided at both ends of the cable feed-thru means. Conductors are embedded in a dielectric material which is moulded within, and protected by, a rigid metal casing or shell.

One problem facing the art today resides in the fact that the potting compounds holding the conductors in place are invariably attacked by the hot oil and hot fluids used to facilitate the pumping of individual oil wells. These fluids attack externally by penetrating the coupling which attaches the lower connector to the feed-thru mandrel, and internally by capillary action of the conductors within the downhole electrical cable. Both actions may result in an electrical failure by means of an electrical shorting action.

In addition, the high pressure differentials cause minute cracks in the rigid bonding materials used, thereby leading to leaks in the system which if not detected may have the effect of causing blow outs in the well whenever a conductor, or pair of conductors is broken loose from the bonding material.

Thus, a basic problem with some prior art techniques resides in the maintenance of the integrity of the dielectric material which encases the conductors, and which passes from a low pressure environment to a high pressure environment. Yet another problem facing the art today is the difficulty and often troublesome process of installing the wellhead conductor in the various types of casing heads in use throughout the petroleum producing industry.

The principal prior art cited in the parent application are U.S. Pat. No. 3,945,700, No. 4,154,302 and No. 4,426,124. Also, an accumulated listing of related patents appears in the parent application.

In view of the foregoing, it is an object of the present invention to provide a new and improved downhole and surface electrical feed-thru connector assembly which will maintain the dielectric strength of the materials which encase the electrical conductors and simultaneously prevent any pressure leaks from developing within and around the electrical conductor.

It is another object of the present invention to provide an improved downhole and surface electrical feed-thru connector assembly wherein the dielectric material is capable of expansion and contraction while ensuring a rigid seal around the electrical conductors and within the mandrel and connector shells within which they are housed or encased.

It is still another object of the present invention to provide an improved downhole and surface electrical feed-thru connector assembly which characterizes a mandrel connector capable of variations in length and which is readily adaptable to accommodate specific wellhead requirements.

It is still another object of the present invention to provide the capability of adapting the improved electric feed-thru connector assembly on a variety of wellhead configurations.

These and other objects of the present invention will be best understood from a consideration of the following detailed description taken in connection with the accompanying drawings which form part of the specification, with the understanding, however, that the invention is not confined to a strict conformity with the drawings but may be changed or modified so long as such changes or modifications make no material departure from the salient features of the invention as expressed in the appended claims.

BRIEF DESCRIPTION OF THE DRAWINGS

FIG. 4 is a partial cross-sectional view of a type GT universal adaptor configuration with a electrical feed-thru completion as described herein.

FIG. 7 is a partial cross-sectional view of a tubing head with a clamp connection at its lower end.

SUMMARY OF THE INVENTION

In summary, this invention includes an elongated mandrel sleeve having an internal sleeve shoulder formed therein and facing the high pressure end of the sleeve with the sleeve being externally adapted for field mechanical connection into high pressure wellhead equipment. An elongated pre-formed rigid high mechanical strength dielectric insulator having an external insulator shoulder is installed within the mandrel sleeve with the insulator shoulder in abutment with the internal shoulder of the sleeve. The insulator support means is mounted and sealed in physically bonded relation within the interior of the mandrel sleeve by means of a dielectric potting material disposed as an insulator sleeve or film in the surface areas between the insulator and the mandrel sleeve. The insulator support has a plurality of holes extending axially in parallel and laterally spaced apart relation through the insulator with each hole having an internal hole shoulder formed therein to face the high pressure end of the sleeve. An elongated rigid electrical conductor having an external conductor shoulder and electrical connectors at either end is installed within each hole with the conductor shoulder in abutment with the hole shoulder. Each electrical conductor is mounted and sealed in physically bonded relation within the interior of the hole by a dielectric potting material as a conductor sleeve or film in the surface areas between the conductor and the side of each hole. A designated integral body made of the dielectric potting material is disposed and sealed in physically bonded relation within the mandrel sleeve and between the electrical conductors at the high pressure end of the mandrel sleeve. The dielectric potting may be an epoxy which may be pliable as cured into place. As provided, the insulator support, the conductors, and the integral body serves to seal off fluids from flow through the mandrel sleeves, limited only by a fluid pressure level sufficiently high to cause physical failure of the material of the insulators. The connector is provided in an embodiment adapted for connection through a wellhead hanger and also as a cable connector adapted for connection to the bottom and the top of a cable and of the bottom and top of the connector as installed in a hanger. Thus, the connector may be used in series as later described.

DESCRIPTION OF THE PREFERRED EMBODIMENTS

Figure 1:
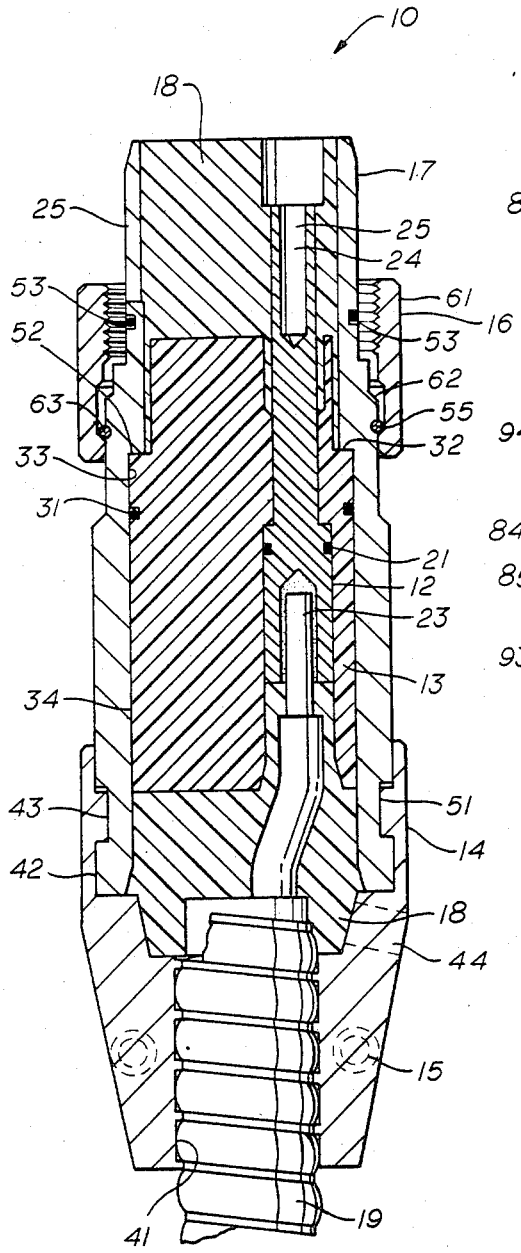
FIG. 1 is a cross-sectional view of the complete electric feed-thru connector assembly of the present invention.

FIG. 1 depicts a complete electric feed-thru connector assembly 10. The main functions of the connector assembly 10 are to provide coupling to electric feed cables at opposite ends of the mandrel shell 7, to conduct high voltage and high current from a surface power source to a downhole pumping system, and to seal off any pressure, gas, or moisture that may tend to enter the feed-thru assembly means 10.

The connector 10 is constructed with various components to ensure a current leakage of no more than twenty micro-amps. It consists of three conductors 12 arranged parallel to each other (one shown) surrounded by an improved insulator 13 of extremely high dielectric strength. On both ends of the insulator 13 is a special potted dielectric material 18 which when completely cured forms a pressure-tight seal throughout the connector 10. Located at the lower end of the connector is a clamp connection 14 secured by four screws 15 when assembled. This clamp 14 is constructed of rigid steel and serves as a locking device with a preferred cable 19. On the opposite ends of the connector 10 is a threaded coupling nut 16 which is a means of sealingly securing the connector 10 to the mandrel shell or sleeve 7, thereby forming a seal which will eliminate any pressure, gas or moisture from entering the feed-thru connector assembly.

The three conductors 12 (one shown) are designed with various special characteristics. Their primary function, however, is to deliver high voltage and high current through the connector 10. The sealing means 21 of the conductor 12 (FIG. 2) forms a back-up seal designed to incorporate long life to the connector 12. Further, it acts to ensure a pressure-tight seal when installed into the insulator 13. These sealing means also protect each individual conductor 12 from any moisture or gas that may escape from the annulus.

The conductors 12 are preferably constructed of a copper alloy, specifically designed to conduct maximum voltage and amperage requirements. The large diameter end of the conductor 12 is designed to have a maximum bearing surface between the conductor 12 and the insulator 13 in case of a well blow-out. The cable insert or socket 23, located at the large diameter and of the conductor 12, is designed to accommodate any prepared cable requirement. Preferably, silver solder is used as a bonding material to ensure a clean positive connection upon the insertion of the cable 19 into the cable insert 23. In some applications, the insert 23 may be bonded to the cable 19 by high pressure mechanical crimping.

Figure 2:
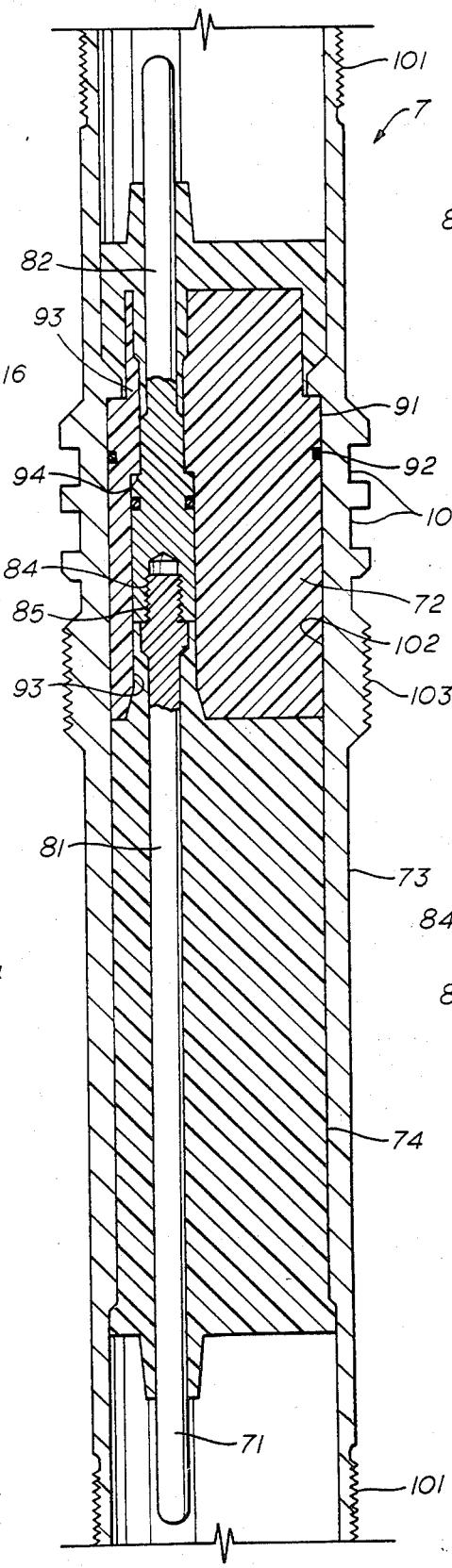
FIG. 2 is a cross-sectional view of the electric feed-thru mandrel assembly of the present invention.

The small diameter end of the conductor is also disposed with inserts 24. These inserts or sockets accommodate the other set of conductors 71 located in the mandrel shell 7 (FIG. 2). The inserts or sockets 24 are designed with four slots 25, each being 90° apart, which run their full length. The conductors 71 in the mandrel shell 7 are slightly larger in diameter than the inside diameter of the connector insert 24, thus allowing the insert to expand when assembled and contract when disassembled.

When the connector 10 is fully plugged into the mandrel shell 7 and secured by the threaded coupling nuts 16, a complete connection is incorporated, thus ensuring 100% conductivity. The three conductors 12 are positioned parallel to each other and are affixed in position with a special potted dielectric material forming a body 18 which withstands constant annulus pressures and insulates the conductors from crossing currents.

The insulator 13 provides a means for completely insulating the internal components of the connector 10 and the mandrel shell 7. It also provides high compression strength so as to withstand maximum working pressure, and a extremely high dielectric strength to minimize possible current leakage.

The insulator 13 is a universal component designed to fit the connector 10 and the mandrel shell 7. A secondary sealing means 31 illustrated as an O-ring may be disposed on its exterior surface to provide a secondary seal. The lower end of its outer surface is designed specifically to provide a maximum bonding surface for the potting material which is formed as a thin sleeve or film between the insulator 13 and the shell 7, making possible operation under maximim working pressures. The three conductors 12, which are axially disposed within longitudinal holes within this unit, have their own sealing means which seal on the insulator 13. The inside diameters 33 (one shown) of the longitudinal holes within which the conductors 12 are disposed run parallel to each other and have a special finish contained therein to ensure a 100% sealing surface for the conductors. The outside diameter 34 of the insulator 13 defines a vertical taper which allows a special potted dielectric material to form a seal between the inside diameter of the shell 17 and the insulator 13. The inside diameters 33 of the longitudinal holes of the insulator are tapered vertically to allow the special potted dielectric material 18 to form a seal around the conductor 12 and within such inside diameters. After complete assembly of the connector 10 and mandrel 7, a special potted dielectric material is injected from both ends, thus sealing and bonding the insulator 13 in its fixed position and eliminating any possible fluid leakage.

The clamp connection 14 serves as a universal means for tightly clamping the preferred cable 19 to the connector 10. It is preferably constructed of a rigid steel and may be adapted to fit any required cable size. The clamp 14 has a two-piece configuration and is adapted such that four screws 15 will secure if together. A cable locking means 41 is machined within the inside diameter of the lower end of the clamp, and is designed to accomodate to the armor of the preferred cable 19. Once installed it is virtually impossible to dislodge the cable 19 from the connector 10 without first removing the four screws 15.

The clamp connection 14 is secured to the connector shell 7 by a groove locking means 42. The connector shell 17 details a groove design which operates in the same manner as the cable locking means. A lug 43 mates with the groove to ensure proper location of the clamp connection 14 from the connector shell 17. Injection ports 44, located 180° apart, are used to inject special dielectric potting material into the completed assembly. This special dielectric potting material forms a body 18 which completely seals all internal gaps designed into the clamp connection for extra protection in critical areas, thus making it one integral unit upon installation. The clamp connection 14 acts to protect the feed-thru means from hostile environments, moisture, constant high annulus pressures and from any well fluids that may attack the feed-thru system.

The connector shell 17 functions primarily as a casing or shell to protect the high voltage and high current internal components from being attacked by any type of hostile environment, constant annulus pressures and well fluids. A groove locking means 51 disposed upon the lower end of the exterior surface of the connector shell 17 is designed to mate with the clamp connection 14. The lug 43 incorporated on the clamp connection 14 mates precisely with the groove 51, thereby making it virtually impossible to dislodge the clamp connection from the connector shell.

The inside diameter of the connector shell 17 details a shoulder 52 which acts as a stop means for the insulator 13. This shoulder gives the insulator a maximum bearing surface upon which to rest, thereby securing it in place and protecting it from any annulus pressures which could possibly cause failure. The inside diameter of the connector sleeve 17 is provided with a special surface finish to insure a positive seal and bond for the special potting dielectric material 18 and the insulator 13. With reference to FIGS. 1 and 2, it is to be noted that the insulator support member 13 of FIG. 1 and the insulator support member 72 of FIG. 2, may be identical and interchangeable. Also, the dielectric potting material 18 shown below and above the insulator member 13 in FIG. 1, may be the same and serve the same function as the unnumbered materials shown in FIG. 2.

As shown in FIGS. 1 and 2, the lower ends of the structures 7 and 10 are seen to be the high pressure ends which are designed to withstand well pressures of the upper end of mandrel 10 and will normally encounter atmoshperic pressures only. When these structures 7 and 10 are utilized in tandem, as shown in FIGS. 4–9, the sealing effectiveness is thereby greatly increased against fluid pressure impressed at the lower end of the structure 10.

Figure 6:
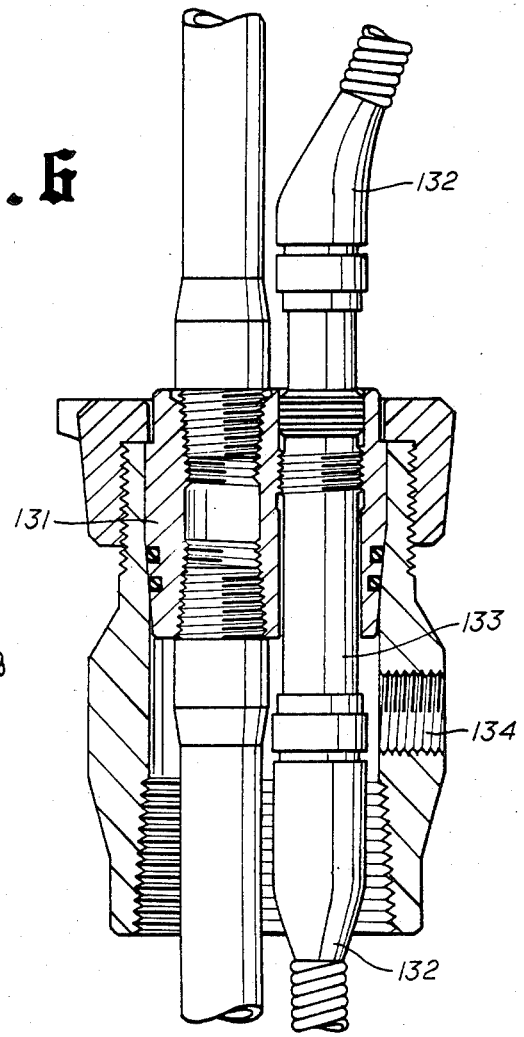
FIG. 6 is a partial cross-sectional view of a threaded tubing head with an electrical feed-thru completion as described herein.
Figure 5:
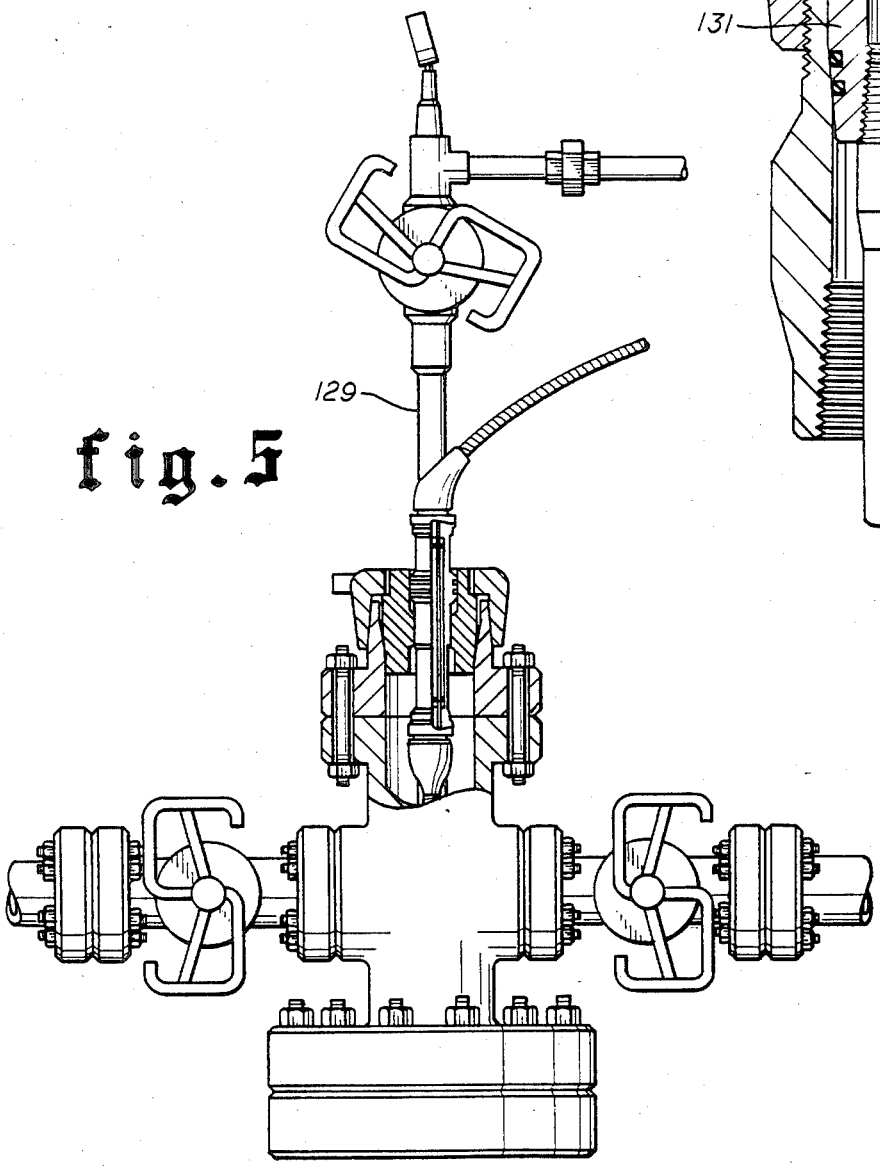
FIG. 5 is a pictorial view of the flanged adaptor of FIG. 4 installed on a tubing head with a threaded valve connection to a production nipple.
Figure 8:
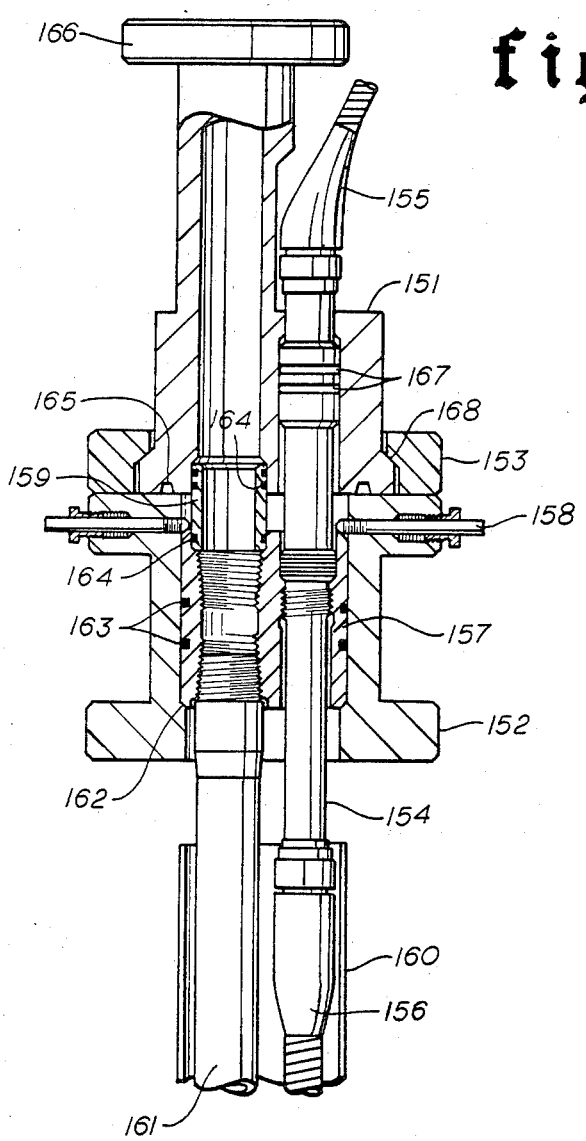
FIG. 8 is a partial cross-sectional view of an adjustable toadstool flange assembly with a electrical feed-thru completion as described herein.
Figure 9:
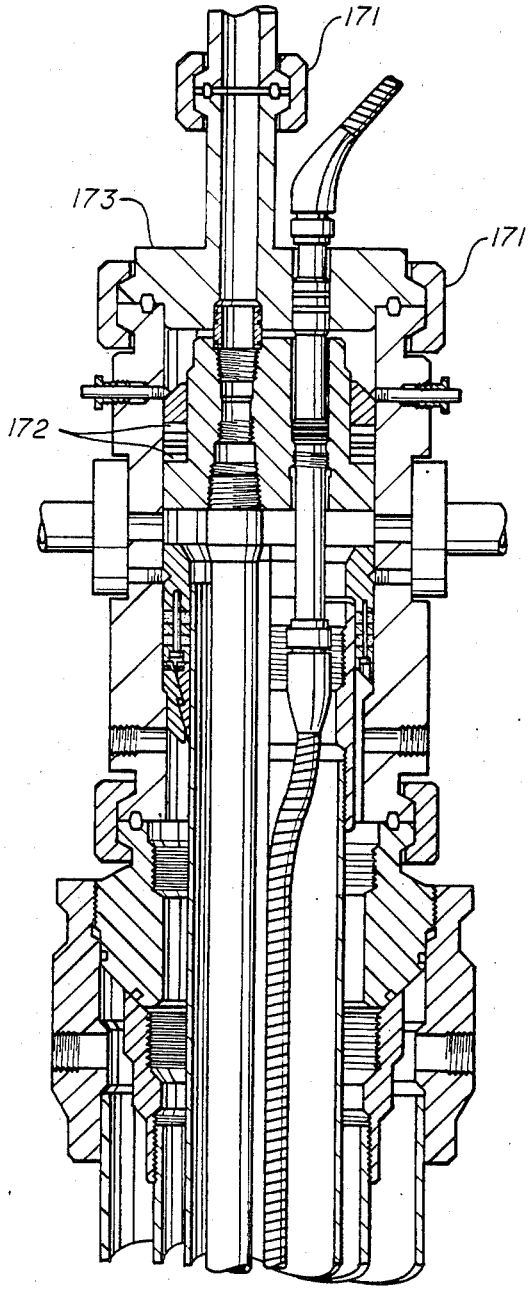
FIG. 9 is a partial cross-sectional view of an electric feed-thru connector assembly installed in a unitized wellhead.

The high pressure resistant structure shown as assembly 10 in FIG. 1 is the same as connectors 112 in FIG. 4, connectors 132 in FIG. 6, connectors 142 in FIG. 7, connectors 155 in FIG. 8, and the unnumbered connections in FIGS. 5 and 9. Likewise, the central mandrel sleeve shown unnumbered and as 7, 113, 133 and 143 in FIGS. 4–9, are the same except for individual length. The upper connector as shown in FIGS. 4–9, such as the upper connector 112 in FIG. 4, are making connection at atmospheric pressure and are not usually needed for pressure resistance since no leakage from the wellhead is previously assured by the series connection of connectors 112 and 113.

Located at the male end (top) of the connector shell 17 is and O-ring groove 53 for use in sealing the mandrel shell 7 to the connector shell 17 when mated for operation. The male end of the connector shell 17 has a specially designed axial alignment groove (not shown) disposed therein to ensure that both the upper connector and the lower connector are in appropriate registry.

The coupling nut 16 appropriately fits over the connector shell 17 at the male end. A groove 55 is disposed on the connector shell 17, and is used to secure the coupling nut 16 with music wire by supplying the wire through the coupling nut 16 into the groove 55, thus allowing the coupling nut to rotate on the connector shell 17 for fast and easy connection and disconnection.

The coupling nut is preferably constructed of a rigid steel. The exterior 61 of the coupling nut 16 is preferably diamond knurled for fast make-up. A groove 62 located on the interior of the coupling nut 16 is specifically designed in reference to the connector shell 17 for easy access to the replaceable seal on the shell. Further, a hole 63 is appropriately disposed on the outside diameter of the coupling nut 16 for feeding in music wire to secure it in place, thereby making it virtually impossible to remove, but ensuring full and complete rotation of the piece.

FIG. 2 details an electric feed-thru mandrel assembly which consists of three two-piece conductors 71 (one shown), one or more insulators 72, a shell 73, special potted dielectric material 74, and a plurality of sealing mechanisms. Its primary function is to isolate constant high annulus pressures and hostile environments from the atmosphere while preventing any moisture or corrosive well fluids from attacking its internal components.

The mandrel assembly of FIG. 2 is preferably fabricated in two basic lengths, depending on the configuration of the wellhead. The short, or mini, mandrel is readily applicable in relatively simple operations. The longer mandrel is used in more complex well completions and can be readily adapted to accommodate specific requirements. Herein, the conductor 71 functions as a means of conducting extremely high voltage and high current from a surface power source to various electrical pumping systems located downhole.

The mandrel shell 7 is preferably constructed of a rigid steel material and is designed with two sealing mechanisms appropriately located on the upper external portion of the shell. In operation, the mandrel shell is axially threaded into the hanger portion of the wellhead with a special thread to withstand any type of force that might occur.

The main function of the insulator 72 is to ensure a maximum compression strength of 50,000 psi, for example, while holding a dielectric strength of no more than 20 micro-amps. It also acts to insulate the conductors 71 from any crossing currents and to ensure a back stop for a flexible potted dielectric material 74 which is injected into both ends of the insulator 72. The special potted dielectric material 74 actually seeps into specially designed areas of the insulator and act as a secondary sealing agent while bonding the insulator into its fixed position.

Figure 3:
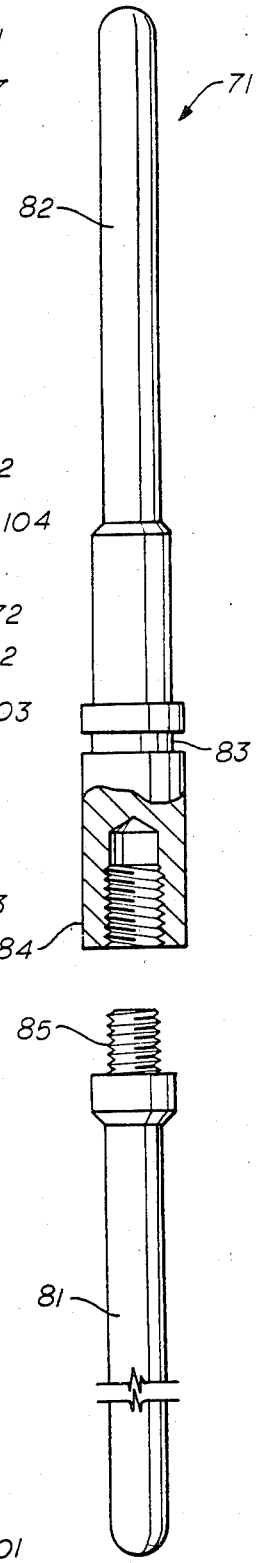
FIG. 3 is a cross-sectional view of a conductor for the mandrel assembly of FIG. 2.

The mandrel conductors 71 have a two-piece configuration and run parallel to each other throughout the mandrel. As can be seen more clearly in FIG. 3, the lower conductors 81 can be adapted to fit any mandrel length while the upper conductors 82 can be universally used in the short mandrel, the long mandrel, or the connector. A sealing means 83 is incorporated on the upper conductor 82 and functions as a permanent fixture when installed into the insulator. Female threads 84 are disposed on the upper conductor 82 and are designed to accept the male threads 85 on a lower conductor 81, thus making the conductor means a universal component by simply lengthening the lower conductor 81 for various mandrel lengths.

In operation, upon installation of the three two-piece conductors, a special potted dielectric material is injected into the mandrel. This material actually forms a permanent seal around each conductor and bonds them in their fixed positions, allowing no room for vertical movement. It also fills all special design areas on the exterior surface of the conductor to ensure stability and proper conductivity.

The conductors 71 are preferably made of a solid copper material and perform the task of conducting high voltage and high current from a power source through a wellhead into a high pressure zone within the well bore of a well. In prior art disclosures, high pressure and hostile environments cause the conductors to become dislodged, thus leaving room for short circuiting and well blow-outs.

The insulator 72 of the mandrel asembly 7 is a universal component constructed to be accommodated within the mandrel shell or connector shell. Its basic function is primarily to serve as an insulation means to insulate critical areas of the conductors from crossing currents, to accomplish a dielectric strength of less than 20 microamps, and to ensure a maximum compression strength of 30,000 psi, for example.

Unlike prior art feed-thru systems, the presently disclosed invention is disposed with multiple sealing means which in fact perform secondary sealing operations. For example, the outside diameter 91 of the insulator 72 for the mandrel assembly 7 have optional tapers (not shown) which allow epoxy material, when injected, form a thin sleeve or film and thereby to bond the insulators to the shell for stability. Further, it incorporates a seal around these critical areas. The O-ring groove 92 ensures a back-up sealing means for use in holding maximum pressures upon expansion and contraction of the flexible epoxy material for testing and field use. The inside diameter 93 (one shown) also have tapers incorporated within for the potting material to form a thin film or sleeve and thereby to bond the conductors upon the injection process, and to seal them completely from moisture and the escape of corrosive gases. The insulator 72 has three inside diameters 93 which are precisely spaced parallel to each other to accommodate the conductor 74 which run the total length of the component. Within the inside diameters 93 is a back stop or bearing shoulder surface 94 facing the high pressure end as shown which acts to ensure against possible movement or blow-out of the conductors.

The mandrel shell or sleeve 73, identified in FIG. 2 functions as an embodiment for the conductors 71, insulators 72, and special dielectric material 74. Its main purpose is to protect all internal components from high annulus pressures, corrosive gases, high temperatures, deteriorating well fluids, and possible intrusion of moisture which could possibly cause electrical or mechanical failure. The mandrel shown may be adapted quickly and easily to any preferred length depending upon the wellhead configuration. In prior art feed-thru devices, particularly Cugini, et al, the mandrel shell does not lend itself to variations in length. Further, they are molded as one complete unit and the entire unit must be replaced when such means wears out or failure occurs.

The mandrel shell 7 of the present disclosure is disposed with threads 101 located at both ends so as to receive coupling nuts thereupon. Upon proper torquing of the coupling nuts 16, the conductors 71 are fully engaged into the connector 10, thereby ensuring 100% conductivity.

The inside diameter 102 of the mandrel shell 7 is disposed with specially designed grooves. The special potted dielectric material 74 engages these grooves and thereby incorporates a rigid bond throughout the interior of the mandrel shell upon completion of the injection process. Located on the middle of the exterior surface of the mandrel shell 7 are male threads 103 which are utilized to secure the complete electric feed-thru means assembly. When fully engaged into the wellhead hanger means two seals 104 are engaged to ensure absolutely no leakage.

FIG. 4 details a partial cross-sectional view of one embodiment of the invention. This flanged adaption comprises a dual tubing hanger 111, upper and lower connectors 112, a mandrel 113, an adaptor flange 114, a heavy duty knock-off cap 115, special O-ring sealing means. The upper portion 116 of the adaptor flange is threaded to accommodate a heavy duty knock-off cap 115 which basically functions to secure the dual tubing hanger into its position. The dual tubing hanger 111 rests on the taper located on the inner circumferential surface of the adaptor flange 114 which activates a positive o-ring seal in this pressure zone. The o-rings eliminate any possibility of pressure, gas or fluids escaping into the atmosphere.

Production tubing 118 is threaded into the lower end of the dual tubing hanger 111. It functions as a means of transporting fluids and gases through the annulus of the inner string of casing to the desired depth for production operations. The upper connection, or production nipple 119, is also threaded into the dual tubing hanger 111. Its primary function is for production outside of the well where threaded valves may be attached.

The electric feed-thru assembly, located adjacent to the production tubing 120, is also threaded into the dual tubing hanger 111. The mandrel shell (see FIG. 2) has male threads on the external portion to accommodate within the dual tubing hanger 111. The two o-rings are activated when the mandrel is threaded into the dual tubing hanger 111. The inner circumference 121 of the adaptor flange 114 as an internal taper to support the dual tubing hanger 111 on its completion as shown. It also functions as a means of incorporating a metal to metal seal between the outer circumference of the dual tubing hanger 111 and the inner circumference of the adaptor flange 114, thereby eliminating any possible pressure, gas or well fluids from escaping into the atmosphere.

Unlike prior art feed-thru assemblies, this electric feed-thru adaptor assembly provides a simple and unique method for adapting a high voltage and high current electrical conduit into a well assembly when completion needs require electrically driven submersible pumps, subsurface monitoring equipment, and similar devices. During landing and completion operations, the dual tubing hanger 111, feed-thru mandrel 113, and production string 118 may be run through a blow-out preventer and landed in place while maintaining complete control over the well. Further, it is well suited for use where standard tubing hangers can not be used.

FIG. 5 depicts the embodiment of FIG. 4 installed on a tubing head with a threaded valve connection to a production nipple 129.

Another embodiment of this invention is delineated in Fig. 6, and may be adapted to accommodate any existing casing. This embodiment details a dual tubing hanger 131, upper and lower connectors 132, electric feed-thru mandrel 133, and special o-ring sealing devices. These components are essentially universal since they can be accommodated within the flanged, as well as the threaded adaptations—the essential difference being the connection on the bottom. Threaded connections are furnished with a tubing head for applications where only casing is existing. Two outlets 134 are basically used for circulation and pressure monitoring in the annulus of the inner string of casing, or production casing. This assembly provides a simple and unique method for adapting high voltage and high current electrical conduits into a wellhead assembly when completion needs require the presence of electrically driven submersible pumps, subsurface monitoring equipment, and similar devices.

FIG. 7 illustrates a cross-sectional view of yet another embodiment of the present invention wherein a tubing head 144 with a clamp connection 145 at the lower end may be adapted to fit any clamp connection. Its basic components are a dual tubing hanger 141, upper and lower connectors 142 and electrical feed-thru mandrel 143, and special o-ring sealing devices. This assembly also provides a simple and unique method for adapting high voltage and high current electrical conduits into a wellhead assembly when required for completion.

Still another embodiment of this invention is depicted in FIG. 8. It comprises a toadstool adaptor 151, a tubing head adaptor 152, an adjustable hold down flange 153, an electric feed-thru long mandrel 154, an upper connector 155, a lower connector 156, a dual tubing hanger 157, lock screws 158, a seal hub 159, and special o-ring sealing devices. The casing 160 is suspended and packed into an existing wellhead (not shown).

The inner circumference of the tubing head adaptor 152 is specially designed to maintain the tubing head 157 in its position while accomplishing a premium seal and maintaining complete suspension of the production tubing 161 and electric feed-thru assembly. During landing operations, the dual tubing hanger 157 is lowered into the bowl of the tubing head adaptor 152. It sits on a 45° shoulder 164 thereby allowing the production tubing 161 and the electric flow-thru assembly to be suspended. Locking screws 158 are then horizontally threaded in through the top flange of the inner circumference of the tubing head adaptor 152. These screws have tapers on their ends which ride on the taper of the dual tubing hanger 157, thereby permitting no movement once set into position.

The outer circumference of the dual tubing hanger 157 has two o-rings 163 which seal on the inner circumference of the tubing head adaptor 152 so as to prevent the escape of pressure, gas, or well fluids. A special taper on the top of tubing hanger 157 allows the locking screws 158 to secure it into its operating position. Two ports located within the dual tubing hanger 157 have a precise facing to accommodate the production tubing 161 and the electric feed-thru connector assembly. Tubing hanger 157 also has a special pocket designed within it to accommodate the seal sub 159 which functions as an external extension linking the dual tubing hanger 157 to the toadstool adaptor 151. It has o-ring seals 164 at each end which fit into specially designed seal pockets. These o-rings 164 make it possible to perform a test on the upper ring gaskets 165 before the valves are attached to the toadstool flange 166. The production tubing 161 is threaded into the upstream end of the dual tubing hanger 167 and is suspended downhole to a desired depth for production purposes. Female threads located on the downstream end of the dual tubing hanger 157, just beneath the seal sub 159, are prepared to accept the tubing joints for landing the dual tubing hanger 157 inside the tubing head adaptor 152.

Located adjacent to the production tubing 161 is an electric feed-thru connector assembly which consists of a long mandrel 154, an upper connector 155, a lower connector 156, and special o-ring sealing means. The long mandrel 154 is equipped with two sets of o-rings 167. The purpose of this double sealing means is to seal two components, the dual tubing hanger 157 and the toadstool adaptor 151 for testing of the upper ring gasket 165, and to eliminate any annulus pressure, gas, or well fluids from escaping into the atmosphere. During landing and completion operations, the long mandrel 154, lower connector 156 (with cable), dual tubing hanger 157 and production tubing 161 may be run through a blow-out preventer, while maintaining complete control of the well.

The toadstool adaptor 151 is preferably constructed of a rigid material and functions primarily as a cap for this particular embodiment. It is disposed with a ring groove 165 and special seal pockets to perform premium sealing tasks. The toadstool flange 166 is constructed to accommodate any desired connection.

The adjustable hold-down flange 153 fits around the lower exterior circumference of the toadstool adaptor 151 and is adjustable to facilitate alignment. Once the toadstool adaptor 151 is installed, the adjustable hold-down flange 153 is lowered to fit on the mating taper 168, thus making it possible to align the bolt pattern of the tubing head adaptor 152 with the bolt pattern of the adjustable hold-down flange 153 before tightening. Unlike prior art electric feed-thru assemblies, this embodiment provides a simple and unique method for adapting a high voltage and high current electric conduit through a preferred wellhead arrangement when required for completion operations.

FIG. 9 details a partial cross-sectional view of another embodiment of the present invention wherein an electric feed-thru connector assembly is installed in a unitized wellhead. The components utilized herein are similar to those mentioned in FIG. 8—the obvious differences being the clamp connection 171, the sealing means on the dual tubing hanger 172, and the toadstool adaptor 173. This wellhead is useful to suspend various casing programs in the offshore industry. In some instances, completion will require electrically driven submersible pumps, subsurface monitoring equipment, and similar devices for production purposes. In this instance, the electric conduit must be installed from the outside of the wellhead, through the wellhead to the desired location. It is critical that no annulus pressures, gases or well fluids be allowed to escape through the wellhead into the atmosphere, or attack the feed-thru means. This unitized embodiment completely deletes any possible leakage of internal or external components, and further, is equipped with a sanitary feed-thru device capable of conducting high voltage and high current through a completion with constant high annulus pressures, corrosive gases and deteriorating well fluids.

From the foregoing it can be seen that this invention is one well-adapted to attain all of the ends and objects hereinabove set forth, together with other advantages which are obvious and which are inherent thereto.

It is to be understood that certain features and subcombination are of utility and may be employed with reference to other features and subcombinations. This is contemplated by and is within the scope of the claims.

As many possible embodiments may be made of the invention without departing from the scope thereof, it is to be understood that all matters herein set forth or shown in the accompanying drawings are to be interpreted as illustrative and not in a limiting sense.

What is claimed is:

1. Integral electrical connection apparatus for feeding electricity between a very high fluid pressure zone and a low fluid pressure zone, comprising:

(a) an elongated mandrel sleeve having an internal sleeve shoulder formed therein and facing the high pressure end of said mandrel sleeve, said mandrel sleeve being externally adapted for sealed mechanical connection into high pressure equipment;

(b) an elongated pre-formed rigid high mechanical strength dielectric insulator support means having an external insulator shoulder installed within said mandrel sleeve with said insulator shoulder in abutment with said internal shoulder of said sleeve;

(c) said insulator support means being mounted in sealed and physically bonded relation within the interior of said mandrel sleeve by means of a dielectric potting material disposed as a insulator film in the surface areas between said insulator support means and said mandrel sleeve;

(d) said insulator support means having a plurality of holes axially extending in parallel and laterally spaced apart relation through said insulator means with each hole of said holes having an internal hole shoulder formed therein and facing the high pressure end of said sleeve;

(e) an elongated rigid electrical conductor member having an external conductor shoulder and with electrical connectors on each end installed within each said hole with said conductor shoulder in abutment with said hole shoulder;

(f) said each electrical conductor member being mounted in sealed and physically bonded relation with the interior of said hole by means of a dielectric potting material disposed as a conductor film in the surface areas between said conductor member and the side of said hole;

(g) said insulator support means and said conductor members as specified being provided within said mandrel sleeve to seal off fluids from flow through said mandrel sleeve limited only by a fluid pressure level sufficiently high to cause physical failure of the material of said insulator support means.

2. The apparatus of claim 1 wherein said electrical connector is selected as a pin or a socket for appropriate connection with another electrical connector.

3. The apparatus of claim 1 wherein said mandrel sleeve is connected into a selected hanger means of a wellhead.

4. The apparatus of claim 1 wherein the inner surface of said mandrel sleeve, which is bonded through said potting material to said insulator support and to said integral body, is provided of surface configuration to enhance its bonding properties.

5. The apparatus of claim 1 wherein a designated integral body of said dielectric potting material is disposed in sealed and physically bonded relation within said mandrel sleeve and between said electrical conductor members at the high pressure end of said mandrel sleeve.

6. The apparatus of claim 1 wherein said dielectric potting material is an epoxy material.

7. The apparatus of claim 6 wherein said epoxy material is pliable as cured.

8. The apparatus of claim 5 further including a second apparatus as specified in claim 5 with the low pressure end of said second apparatus connected with the high pressure end of said apparatus of claim 5 and with the high pressure end of said second apparatus connected to an electrical power cable extending down into a well.

9. The apparatus of claim 8 wherein said electrical conductor is comprised of a first member disposed in said hole as specified and a second member removably connected to said first member and extending through said integral body.

10. The apparatus of claim 8 wherein the low pressure end of said mandrel sleeve is in connection with a surface located power cable through a cable connector.

11. Integral wellhead electrical connection apparatus for feeding electricity between a very high fluid pressure zone and a low fluid pressure zone, comprising:

(a) an elongated mandrel sleeve having an internal sleeve shoulder formed therein and facing the high pressure end of said mandrel sleeve, said mandrel sleeve being externally adapted for sealed mechanical connection into high pressure equipment;

(b) an elongated pre-formed rigid high mechanical strength dielectric insulator support means having an external insulator shoulder installed within said mandrel sleeve with said insulator shoulder in abutment with said internal shoulder of said sleeve;

(c) said insulator support means being mounted in sealed relation within the interior of said mandrel sleeve by means of sealing means, support means and said mandrel sleeve;

(d) said insulator support means having a plurality of holes axially extending in parallel and laterally spaced apart relation through said insulator means with each hole of said holes having an internal hole shoulder formed therein and facing the high pressure end of said sleeve;

(e) an elongated rigid electrical conductor member having an external conductor shoulder and with electrical connectors on each end installed within each said hole with said conductor shoulder in abutment with said hole shoulder;

(f) said each electrical conductor member being mounted in sealed relation with the interior of said hole by means of sealing means;

(g) a designated integral body of dielectric potting material disposed in sealed and physically bonded relation within said mandrel sleeve and between said electrical conductor members at the high pressure end of said mandrel sleeve;

(h) said insulator support means, said conductor members, and said integral body as specified being provided within said mandrel sleeve to seal off fluids from flow through said mandrel sleeve limited only by a fluid pressure level sufficiently high to cause physical failure of the material of said insulator support means.

12. The apparatus of claim 11 wherein said dielectric potting material is an epoxy material.

13. The apparatus of claim 12 wherein said epoxy material is pliable as cured.

14. Integral wellhead electrical connection apparatus for feeding electricity between a very high fluid pressure zone and a low fluid pressure zone, comprising:

(a) an elongated mandrel sleeve having an internal sleeve shoulder formed therein and facing the high pressure end of said mandrel sleeve, said mandrel sleeve being externally adapted for sealed mechanical connection into high pressure equipment;

(b) an elongated pre-formed rigid high mechanical strength dielectric insulator support means having an external insulator shoulder installed within said mandrel sleeve with said insulator shoulder in abutment with said internal shoulder of said sleeve;

(c) said insulator support means being mounted in sealed relation within the interior of said mandrel sleeve by means of sealing means, support means and said mandrel sleeve;

(d) said insulator support means having a plurality of holes axially extending in parallel and laterally spaced apart relation through said insulator means with each hole of said holes having an internal hole shoulder formed therein and facing the high pressure end of said sleeve;

(e) an elongated rigid electrical conductor member having an external conductor shoulder and with electrical connectors on each end installed within each said hole with said conductor shoulder in abutment with said hole shoulder;

(f) said each electrical conductor member being mounted in sealed relation with the interior of said hole by means of said sealing means and the side of said hole; and (g) said insulator support means, said conductor members, and said integral body as specified being provided within said mandrel sleeve to seal off fluids under high fluid pressure.

15. The apparatus of claim 14 wherein said mandrel sleeve is connected into a selected hanger means of a wellhead and wherein said apparatus further includes a second apparatus as specified in claim 14 with the low pressure end of said second apparatus connected with the high pressure end of said apparatus of claim 14 and with the high pressure end of said second apparatus connected to an electrical power cable extending down into a well.

16. A flanged tubing head adaptor structure wherein the electric feed through connector assembly of claim 1 is installed onto a flanged tubing head, said structure comprising (1) a dual tubing hanger, (2) an electric feed-thru connector assembly as described in claim 1, (3) an adaptor flange, (4) a heavy duty knock-off cap and, (5) special o-ring sealing devices.

17. The structure as set forth in claim 16, wherein the mandrel shell described in claim 1 is threadedly connected in the remaining space of said dual tubing hanger, thereby disposing said o-rings in a seal pocket on the tubing hanger, and thus creating a positive seal against annulus pressure.

18. The structure as set forth in claim 16, wherein said adaptor flange incorporates a metal to metal seal between the outer circumferential surface of said dual tubing hanger and the inner circumferential surface of said adaptor flange to eliminate any possible pressure, gas or well fluid from escaping into the atmosphere.

19. The structure as set forth in claim 16, wherein said dual tubing hanger, said mandrel connector, and a production string run through an existing blow-out preventer and landed in place while maintaining complete control of the well.

20. A threaded adaptor structure for installing the electric feed through connector assembly of claim 1 onto a production casing comprising (1) a dual tubing hanger, (2) an electric feed-thru connector assembly as described in claim 1, (3) a heavy duty knock-off cap, and (4) special o-ring sealing devices, and (5) threaded tubing head.

21. The structure as set forth in claim 20, wherein said tubing head has a specially tapered inner circumferential surface which accommodate said dual tubing hanger.

22. The structure as set forth in claim 20, wherein said dual tubing hanger seats on the specially tapered inner circumferential surface described in claim 20 to actuate a positive o-ring seal, thereby eliminating the possibility of any pressure, gas, or fluid from escaping into the atmosphere.

23. The structure as set forth in claim 20, wherein said production tubing is threadedly connected to the upstream end of said dual tubing hanger to conduct fluids and gases from the annulus of existing production casing to the desired depth for production operation.

24. The structure as set forth in claim 20, wherein said mandrel shell of said connector assembly is threadedly connected to said dual tubing hanger thereby disposing said o-rings in a seal pocket on said tubing hanger, thereby creating a positive seal against annulus pressures.

25. The structure as set forth in claim 20, wherein said tubing head incorporates a metal to metal seal between the outer circumferential surface of the dual tubing hanger and the inner circumferential surface of the adaptor flange thereby eliminating any possible pressure, gas, or well fluids from escaping into the atmosphere.

26. The structure as set forth in claim 20, wherein said dual tubing hanger, electric feed-thru connector assembly and a blow-out preventer are landed in place while maintaining complete control of the well.

27. The structure as set forth in claim 20, wherein said tubing head has two threaded connections for use in circulation and pressure monitoring in the annulus of the inner string of casing or production casing.

28. An adaptor structure for installing the electric feed-thru mandrel connector assembly of claim 1 onto any standard clamp connector comprising of (1) a tubing head; (2) a dual tubing hanger; (3) an electric feed-thru assembly as described in claim 1; (4) a heavy duty knock-off cap and (5) special o-ring sealing devices.

29. The structure as set forth in claim 28, wherein said tubing head incorporates a specially tapered inner circumferential surface which accommodates said dual tubing hanger.

30. The structure as set forth in claim 28, wherein said dual tubing hanger seats on said specially tapered inner circumferential surface or as to actuate a positive o-ring seal, thereby eliminating the possibility of any pressure, gas, or fluid escaping into the atmosphere.

31. The structure as set forth in claim 28, wherein said dual tubing hanger, said mandrel connector and a production string are run through an existing blow-out preventer and landed in place while maintaining complete control of the well.

32. An adaptor structure wherein the electric feed-thru connector assembly of claim 1 is installed onto a wellhead comprising (1) a toadstool adaptor: (2) tubing head adaptor; (3) adjustable hold down flange, (4) an electric feed-thru long mandrel, (5) upper and lower connector, (6) a dual tubing hanger, (7) lock screws, (8) a seal hub: (9) special o-ring sealing device, (10) and an upper ring gasket.

33. The structure as set forth in claim 32, wherein said tubing head adaptor has upper and lower flange surfaces.

34. The structure as set forth in claim 32, wherein the lower surface of said hold down flange will mate to tubing heads and the inner circumferential surface is specially designed to hold said dual tubing hanger while accomplishing a premium seal and maintaining complete suspension of a production tubing string and said electric feed-thru connector assembly.

35. The structure as set forth in claim 32, wherein said tubing head adaptor has locking screws horizontally threaded into said upper flanged surface which engage said special taper, thus allowing no movement of said dual tubing hanger when set into position.

36. The structure as set forth in claim 32, wherein said dual tubing hanger has two of said special o-ring sealing devices which seal on the said inner circumferential surface allowing no escape of gas, pressure of fluids.

37. The structure as set forth in claim 32, wherein said dual tubing hanger incorporates a special pocket to accommodate said seal sub which functions as an internal extension linking said dual tubing hanger to said toadstool adaptor.

38. The structure as set forth in claim 32, wherein said ring gasket is located between the upper surface of said tubing head adaptor and the lower surface of said toadstool adaptor creating a seal when said adjustable hold down flange is tightened into place.

39. The structure as set forth in claim 32, wherein said toadstool adaptor and said dual tubing hanger has special pockets to accept one each of said special o-ring sealing devices which are located at opposite ends of said seal sub and which allow testing of said ring gasket prior to attaching valves to said toadstool adaptor flange.

40. The structure as set forth in claim 32, wherein during the landing and completion operation, said electric feed-thru long mandrel, lower connecter and cable, dual tubing hanger and production tubing are all run through an existing blow-out preventer while maintaining complete control over the well.

* * * * *